US006954181B2

(12) United States Patent
Park et al.

(10) Patent No.: US 6,954,181 B2
(45) Date of Patent: Oct. 11, 2005

(54) ANTENNA APPARATUS FOR MOBILE COMMUNICATION TERMINAL

(75) Inventors: Jong-Kui Park, Suwon-shi (KR); Dong-In Ha, Yongin-shi (KR); Krylov Konstantin, Suwon-shi (KR); Ju-Hyung Lee, Kwachon-shi (KR)

(73) Assignee: Samsung Electronics Co., Ltd. (KR)

( * ) Notice: Subject to any disclaimer, the term of this patent is extended or adjusted under 35 U.S.C. 154(b) by 105 days.

(21) Appl. No.: 10/646,152

(22) Filed: Aug. 21, 2003

(65) Prior Publication Data

US 2004/0108959 A1 Jun. 10, 2004

(30) Foreign Application Priority Data

Dec. 6, 2002 (KR) ..... 10-2002-0077167

(51) Int. Cl.[7] ..... H01Q 1/24
(52) U.S. Cl. ..... 343/702; 343/700 MS
(58) Field of Search ..... 343/700 MS, 702, 343/724, 725, 793, 853

(56) References Cited

U.S. PATENT DOCUMENTS 5,691,730 A * 11/1997 Egashira et al. ..... 343/702
5,905,467 A * 5/1999 Narayanaswamy et al. . 343/702

* cited by examiner

*Primary Examiner*—Shih-Chao Chen
(74) *Attorney, Agent, or Firm*—Dilworth & Barrese LLP

(57) ABSTRACT

An antenna apparatus for a mobile communication terminal to achieve better portability and to prevent damage from careless handling by a user. The antenna is installed inside a main body of the mobile terminal, to render more room for accommodating its components. The antenna apparatus includes the main body having therein a main board, a keypad assembly provided with a plurality of key tops formed exposedly on the upper surface of the main body, and an antenna section disposed, between the main board and the keypad assembly, opposite to and in the vicinity of the lower end of the main body. The antenna section is comprised of an antenna sheet disposed underneath the keypad assembly.

19 Claims, 9 Drawing Sheets

ANTENNA APPARATUS FOR MOBILE COMMUNICATION TERMINAL

CLAIM OF PRIORITY

This application claims priority to an application entitled "Antenna Apparatus for Mobile Communication Terminal" filed in the Korean Industrial Property Office on Dec. 6, 2002 and assigned the application serial No. 2002-77167, the contents of which are incorporated herein by reference.

BACKGROUND OF THE INVENTION

1. Field of the Invention

The present invention relates generally to a mobile wireless communication terminal and, in particular, to an antenna apparatus for use in mobile wireless communication terminals such as mobile phones, hand-held personal computers, personal digital assistants (PDAs), etc.

2. Description of the Related Art

In recent years, mobile communication systems that are in common use by a great number of mobile subscribers have extended their available services to include paging service, mobile phone calling, short message service (SMS) to a mobile banking service system, and further up to a multimedia service such as motion picture service and the like. The tremendous growth of the mobile communication systems with a diversity of service functions has led to the need to make more use of an integrated type of wireless terminal devices such as PDAs and the like, which serve as both a personal computer and a mobile communication terminal equipment, e.g. mobile phone, because a conventional mobile phone is to some degree limited in the extent of its functions.

Referring to FIG. 1, there is shown a schematic front view of a conventional mobile communication terminal 100, that is to say, e.g. a PDA. As seen in the front view, the mobile communication terminal 100 is provided with a display unit 101 in its front, under which a keypad assembly 105 is arranged and above which a speaker 109 is disposed. As the keypad generally has a limit in the scope of data capable of inputting as an input means, the display unit 101 may be implemented as an input device using a touch screen. On one side of an upper end of the mobile terminal 100 is disposed an antenna 107 and on an other side of the upper end of the mobile terminal 100 is disposed a camera module 111, of which photographing angle is adjustable by an adjusting knob 113 disposed on one side of the upper end of the mobile terminal 100 and adjacent to the camera module 111.

Referring then to FIGS. 2 and 3, the keypad 105 is comprised of a silicon keypad 151 provided with a plurality of key buttons 151*a* projecting to the outside of the mobile terminal 100, and a flexible printed circuit board 153 for the keypad. The flexible printed circuit board 153 is provided with electrical contacts corresponding to the plurality of key buttons 151*a* and is adapted to generate a set of electrical signals S for supplying to a main board 157 of the mobile terminal according to the manipulation of the key buttons 151*a* by a user. The flexible printed circuit board 153 is connected to a data cable 153*b* for transferring the electrical signal S to the main board 157. The keypad is disposed on a cover 155 mounted to protect the main board 157. Further, a respective key button 151*a* of the silicon keypad 151 may be preferably attached at its upper surface to a plastic material (not sown) or the like for offering more pleasant touch to the users.

In the meantime, the tremendous increase of data and information transferred using the mobile communication terminal, as during a multi-media content service, essentially demands high-speed data transmission in the mobile communication service system. Hence, a diversity antenna has been proposed in the art as one preferred solution for improving the data transfer rate as well as the quality of data transfer.

Referring now to FIG. 4, which illustrates a front view of a mobile wireless communication terminal 200, e.g. a PDA, with such a diversity antenna 203 of the prior art, being further provided with an additional, second antenna 203 mainly used for the diversity receiving function. The front surface of the mobile terminal 200 includes a display unit 201, below which display unit 201 and keypad assembly 205 are disposed, and above which a speaker 209 is disposed. On one side of the upper end of the mobile terminal 200 is positioned a first antenna 207 for a general transmitting/receiving function, while on the other side of the upper end the second diversity antenna 203 is positioned for the diversity receiving function. Here, the second diversity antenna 203 in the signal receiving operation of the mobile terminal serves to prevent fading phenomena by means of receiving radio waves separately from the first antenna, wherein the fading phenomenon is referred to as a physical phenomenon that significant degradation of signal strength or quality, or transfer rate or the like that is mainly owing to the physical change in medium through which radio waves pass, the diffraction of radio waves or the phase difference between more than one receiving path of the radio waves transmitted from the same origination. That is to say, a combination of two signals each received through the first and second antennas 207 and 203 enables effective detection of an optimal receiving signal, so as to prevent the fading phenomenon to obtain better quality of signal. This will also be quite helpful to achieve remarkable improvement of transfer rate in the mobile communication system.

Meanwhile, FIG. 5 shows a front view of a mobile wireless communication terminal 300, e.g. a PDA, with the diversity receiving antenna 303 arranged in such a way that it extends downwardly from the opposite, i.e. lower, end of the mobile terminal 300, so that the second antenna is positioned apart from the first antenna 307 enough to carry out the diversity receiving function efficiently. The remaining components of the mobile terminal 300, inclusive of a display unit 301, a keypad assembly 305, a speaker 309, a camera module 311 and so on, may be arranged in a similar way to the foregoing construction described with reference to FIGS. 1 to 4.

However, the conventional type of mobile communication terminal as described above has a disadvantage that it may be not only inconvenient for some users to carry owing to such a protrusion of the second antenna from a main body of the mobile communication terminal, but also it may be subject to damage should the user happen to drop it down onto a hard floor carelessly. Further, such an antenna apparatus has some degree of limitation in design since it has a protrusion part extending outwardly from the main body of the mobile terminal. Furthermore, in the design of the mobile communication terminal with the diversity antenna apparatus, it will technically not be easy for a designer to ensure a space for adequately accommodating the diversity antenna apparatus inside the mobile communication terminal because its interior parts are essentially to be configured very compactly in a limited spacing.

SUMMARY OF THE INVENTION

It is, therefore, an object of the present invention to provide an antenna apparatus for a mobile communication terminal, being capable of achieving better portability and being less prone to damage of the antenna apparatus from careless handling.

It is another object of the present invention to provide an antenna apparatus for a mobile communication terminal capable of being installed inside a main body of the mobile communication terminal, so as to render more room for accommodating its components.

Accordingly, to achieve the above objects of the present invention, an antenna apparatus for a mobile communications terminal includes a main body serving as a housing for the mobile communication terminal, said main body having therein a main board, a keypad assembly provided with a plurality of key tops formed on the upper surface of the main body, and an antenna section disposed between the main board and the keypad assembly, opposite to and in the vicinity of the lower end of the main body.

According to a second aspect of the present invention, an antenna apparatus for a mobile communication terminal includes a main body serving as a housing for the mobile communication terminal, said main body having therein a main board, a keypad assembly provided with a plurality of key tops exposed on the top surface of the main body, a first antenna disposed in vicinity of the upper end section of the mobile communication terminal for use in the signal receiving/transmitting function of a radio frequency signal through the mobile communication terminal, and a second antenna disposed between the main board and the keypad assembly, opposite to and in the vicinity of the lower end of the main body.

Preferably, the second antenna is comprised of at least one antenna sheet arranged underneath the keypad assembly between the main board and the keypad assembly, in such a way that, on said antenna sheet, a predetermined antenna pattern of a conductive material is formed.

Preferably, the antenna apparatus further includes a flexible printed circuit board for the keypad assembly arranged between the main board and the keypad assembly, including a plurality of contacts for generating an electrical signal for inputting to the main board according to each operation of a plurality of key buttons arranged in the keypad assembly, at least one antenna sheet inserted between the flexible printed circuit board and the main board, or between the flexible printed circuit board and the keypad assembly, wherein the antenna sheet is provided thereon with a predetermined antenna pattern consisting of a conductive material.

According to a third aspect of the present invention, an antenna apparatus for a mobile communication terminal includes a main body having therein a main board, a keypad assembly provided with a plurality of key tops formed on the top surface of the main body, a flexible printed circuit board for the keypad assembly, arranged between the main board and the keypad assembly, for generating an electrical signal for inputting to the main board according to each operation of a plurality of key buttons arranged in the keypad assembly, and at least one antenna means inserted between the flexible printed circuit board and the main board, or between the flexible printed circuit board and the keypad assembly.

Advantageously, the antenna means further comprises at least one antenna sheet inserted between the flexible printed circuit board and the main board, or between the flexible printed circuit board and the keypad assembly, and a predetermined antenna pattern consisting of a conductive material coated on the antenna sheet.

Advantageously, the antenna means is one selected from a group comprised of a planar inverted F-type antenna, a meander antenna with plural curvatures, a loop antenna, or a wired antenna.

BRIEF DESCRIPTION OF THE DRAWINGS

The foregoing and other features and advantages of the invention will be apparent from the following detailed description of preferred embodiments as illustrated in the accompanying drawings, wherein same reference characters refer to the same parts or components throughout the various views. The drawings are not necessarily to scale, but the emphasis instead is placed upon illustrating the principles of the invention, wherein.

DETAILED DESCRIPTION OF THE PREFERRED EMBODIMENTS

In the following description, for purposes of explanation rather than limitation, specific details are set forth such as the particular architecture, interfaces, techniques, etc., in order to provide a thorough understanding of the present invention. However, it will be apparent to those skilled in the art that the present invention may be practiced in other embodiments, which depart from these specific details. For the purpose of simplicity and clarity, detailed descriptions of well-known devices and methods are omitted to avoid obscuring the description of the present invention with unnecessary detail.

Figure 1:
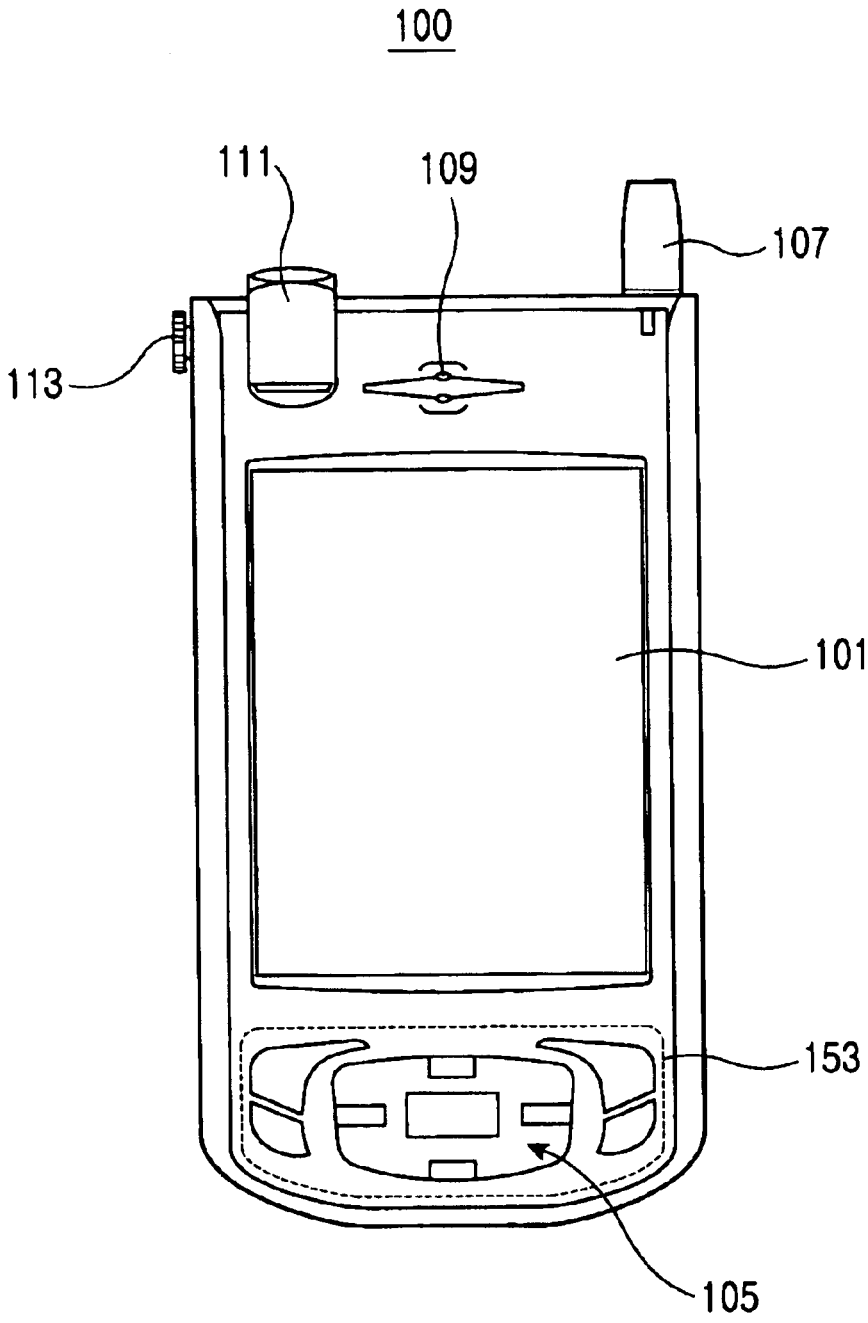
FIG.1 (PRIOR ART)
FIG. 1 illustrates a front view of a conventional mobile communication terminal.
Figure 2:
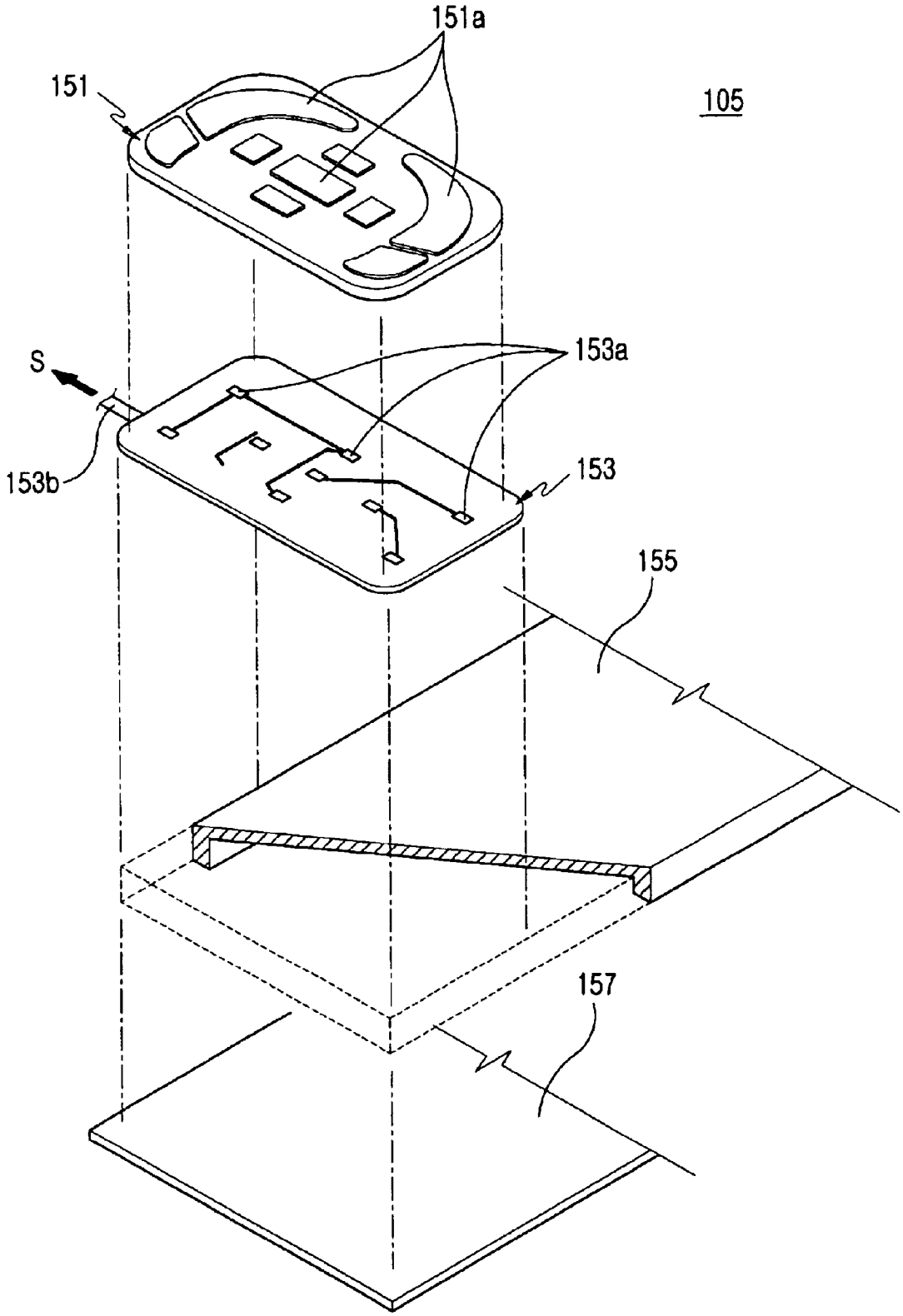
FIG.2 (PRIOR ART)
FIG. 2 illustrates an exploded perspective view of a keypad assembly of the conventional mobile communication terminal shown in FIG. 1.
Figure 3:
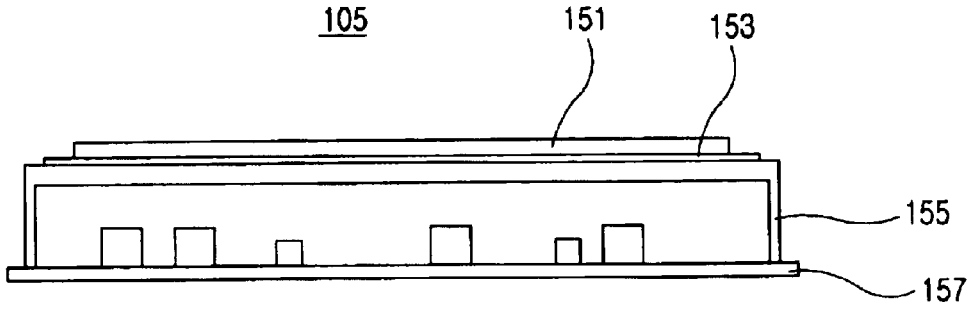
FIG.3 (PRIOR ART)
FIG. 3 illustrates a schematic sectional side view of the keypad assembly according to the conventional mobile communication terminal shown in FIG. 2.
Figure 4:
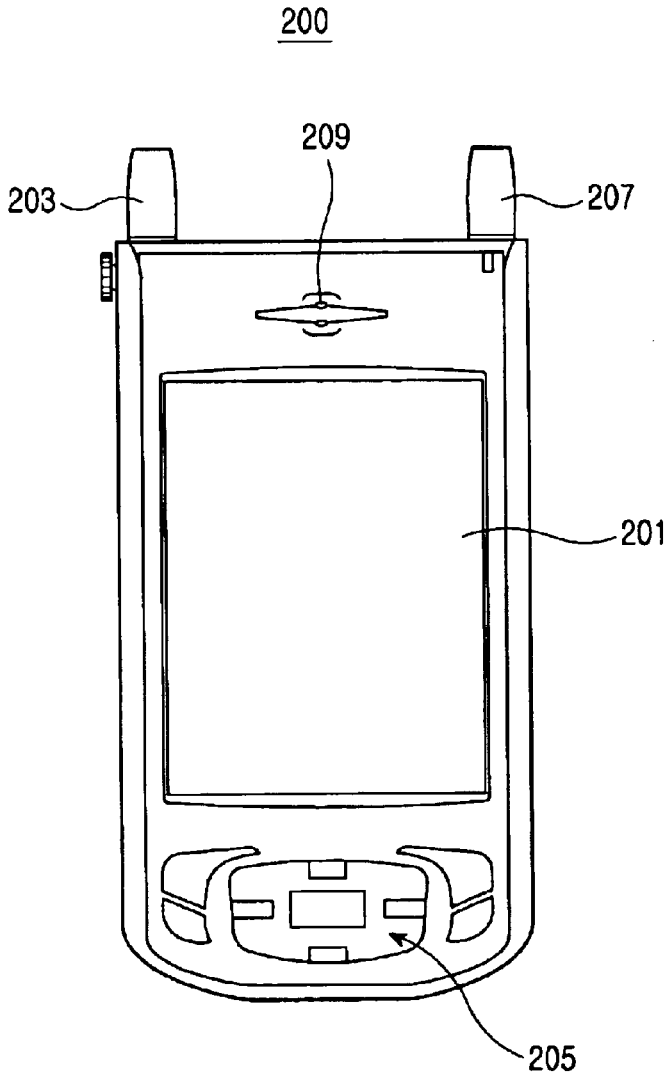
FIG.4 (PRIOR ART)
FIG. 4 illustrates a front view of another conventional mobile communication terminal provided with a diversity antenna.
Figure 5:
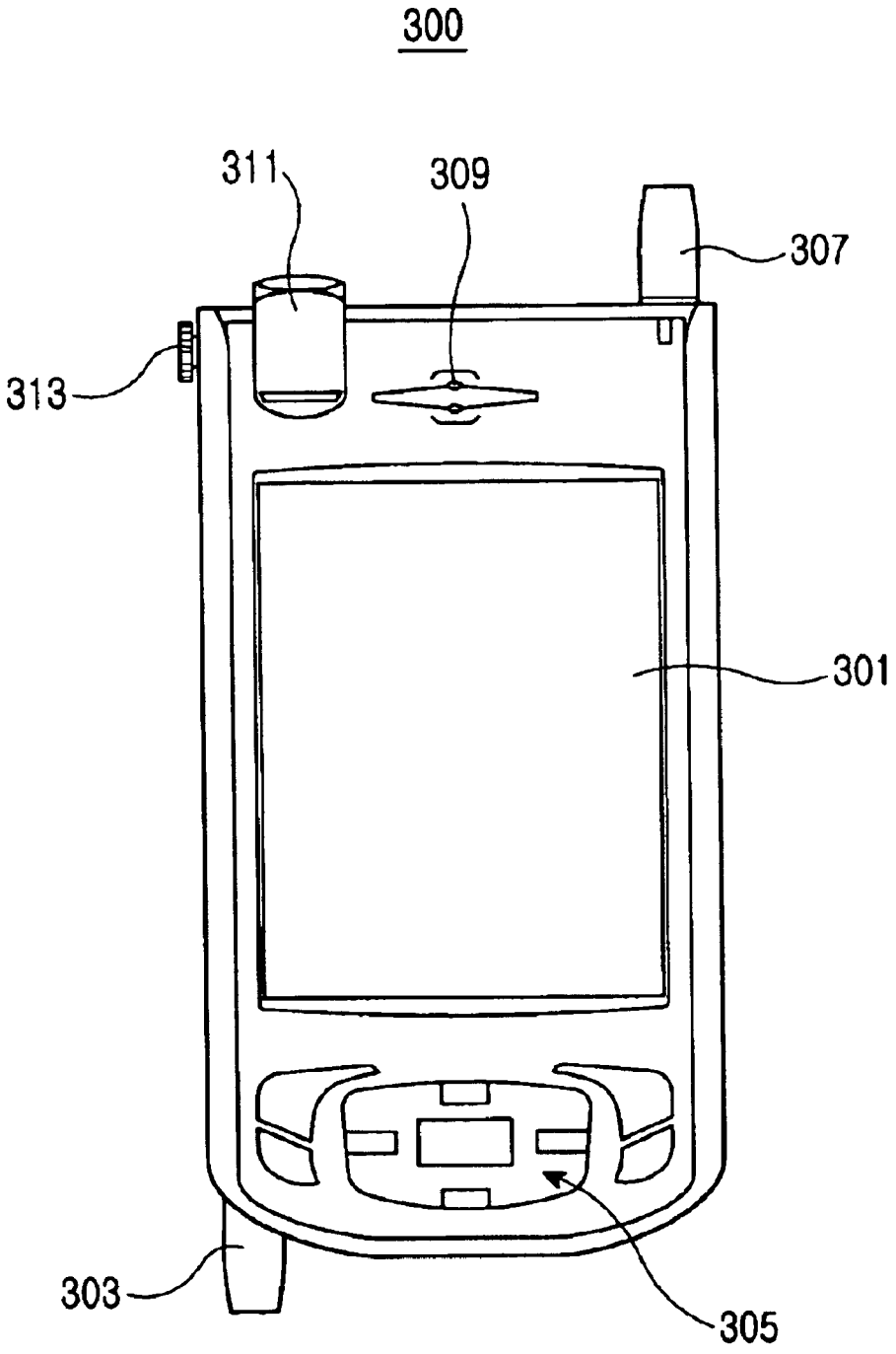
FIG.5 (PRIOR ART)
FIG. 5 illustrates a front view of still another conventional mobile communication terminal provided with a diversity antenna.
Figure 6:
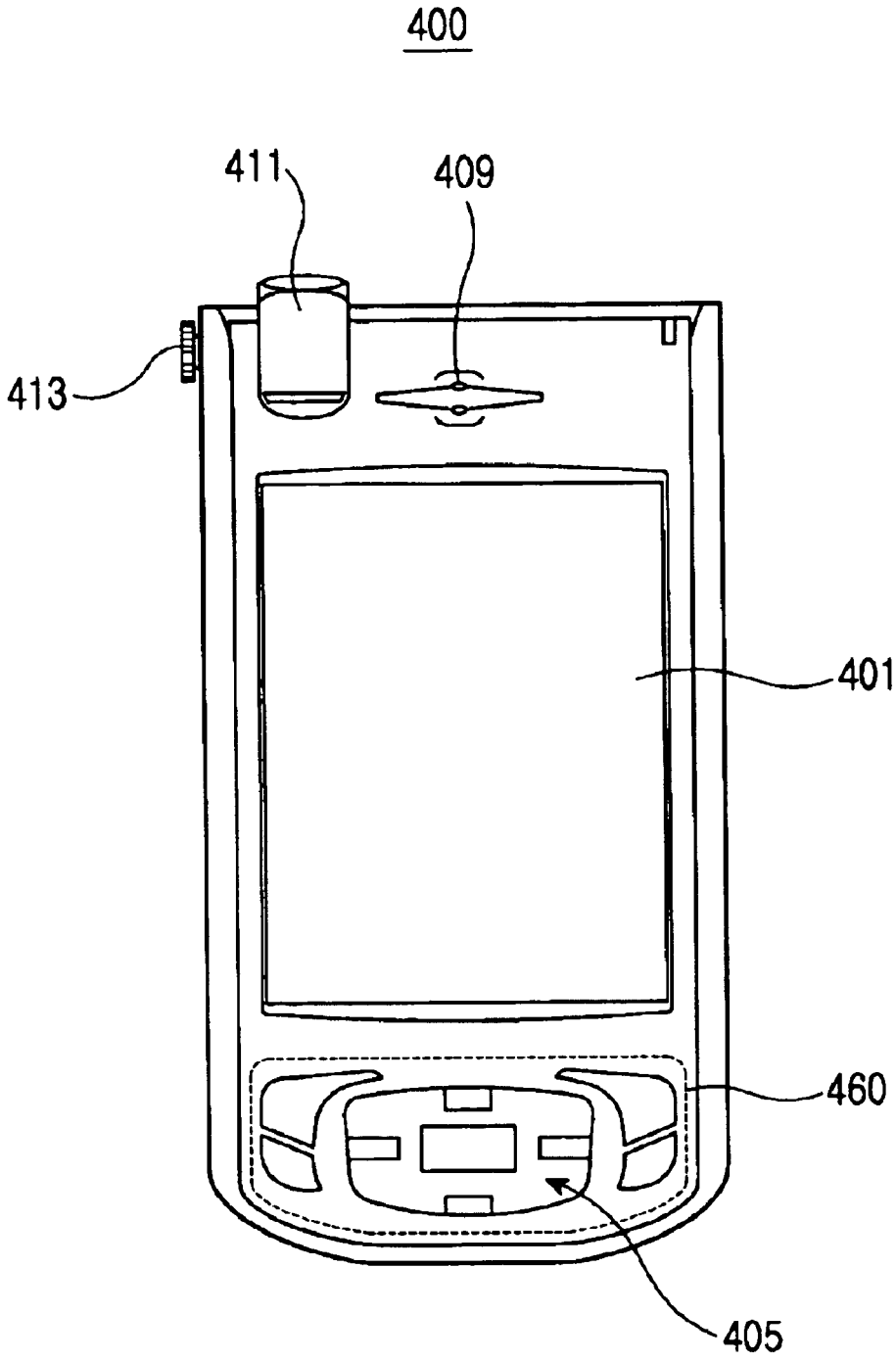
FIG. 6 illustrates a front view of a mobile communication terminal having an antenna apparatus according to a preferred embodiment of the present invention.

Referring now to FIG. 6, a structure of an antenna apparatus 460 will be described according to a preferred embodiment of the present invention. FIG. 6 illustrates a front view of a mobile communication terminal 400, e.g. a PDA, provided with the antenna apparatus 460 according to the present invention. The antenna apparatus 460 is disposed in the vicinity of the keypad 405, underlying the same, as viewed from the front of the mobile terminal 400. The mobile terminal 400 is provided on its front with a display unit 401, beneath which a keypad assembly 405 is arranged and above which a speaker 409 is disposed. On an upper end of the mobile terminal 400 is disposed a camera module 411, of which a photographing angle is adjustable by an adjusting knob 413, disposed on one side of the upper end of the mobile terminal 400. The display unit 401 may be configured in such a way that it has the largest possible display area within the entire top surface of a main body of the mobile terminal 400, so as to enable viewing a motion picture or using video phone thereon with more ease. Therefore, the keypad assembly 405 is preferably provided with only those essentially required basic key buttons 451*a* (FIG. 7) such as "menu" key, "power" on/off key and so on, and the display unit 401 may be formed of a touch screen, which enables use as an input device for entering a variety of data into the mobile terminal.

Figure 7:
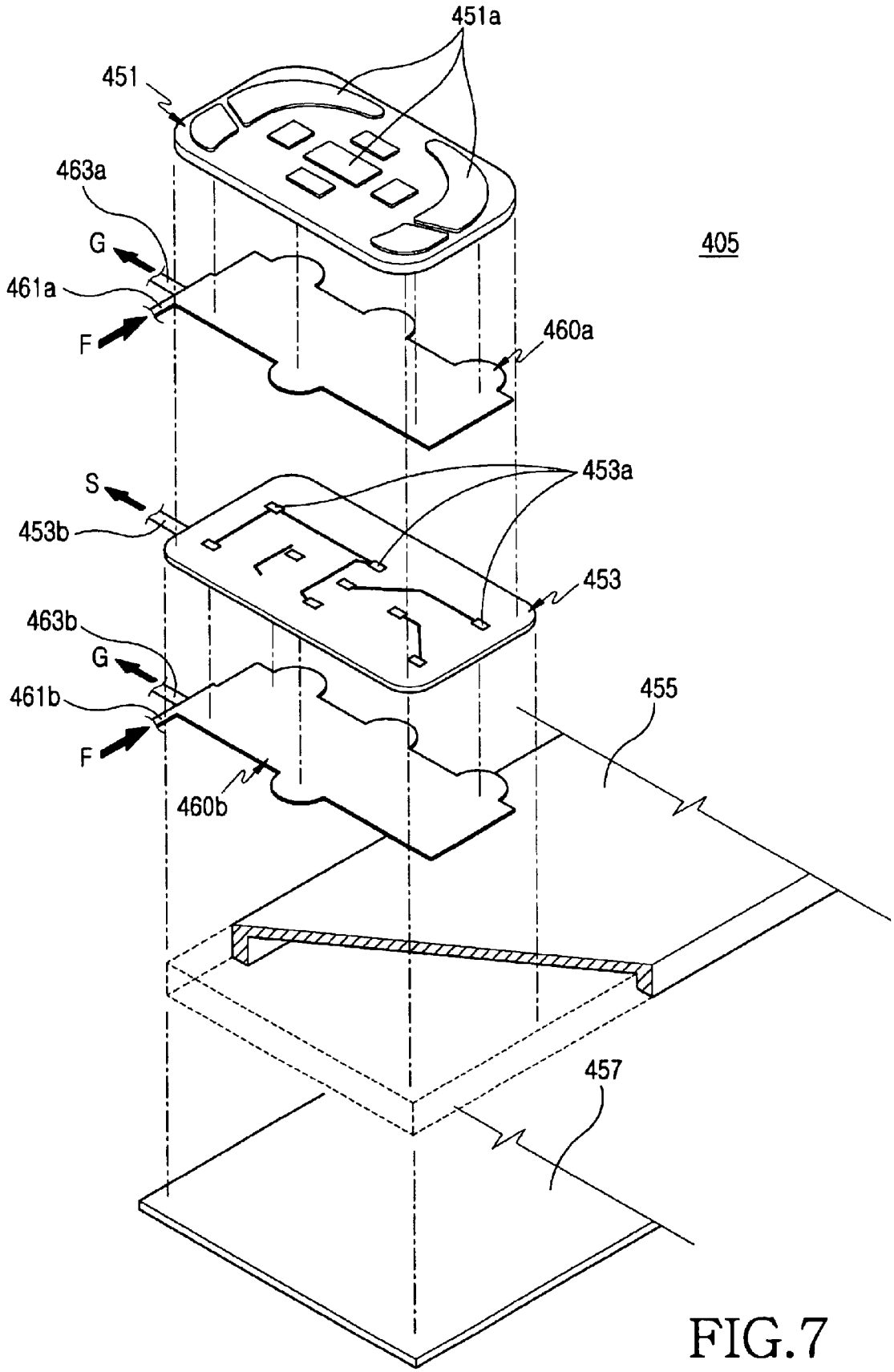
FIG. 7 illustrates an exploded perspective view of a keypad assembly and an antenna apparatus of the mobile communication terminal shown in FIG. 6.
Figure 8:
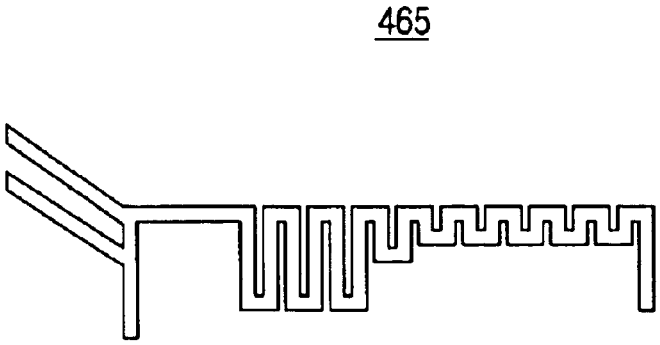
FIG. 8 illustrates an antenna pattern formed for the antenna apparatus of the mobile communication terminal shown in FIG. 7.
Figure 9:
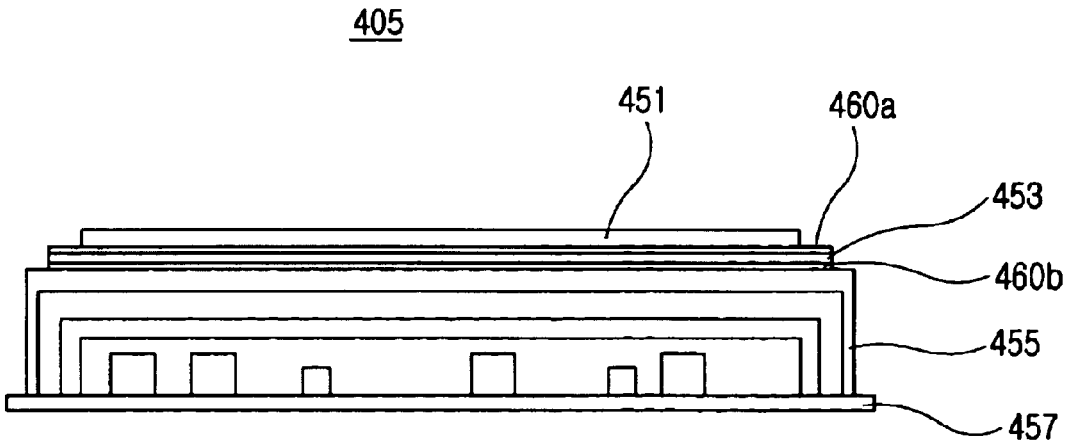
FIG. 9 illustrates a partial sectional view of the keypad assembly and the antenna apparatus of the mobile communication terminal shown in FIG. 7.

Referring to FIGS. 7 to 9, a detailed description to the keypad 405 and the antenna apparatus 460 is provided. FIG. 7 illustrates an exploded perspective view of the keypad assembly 405 and the antenna apparatus 460 of the mobile communication terminal 400 shown in FIG. 6, and FIG. 8 illustrates an example of an antenna pattern 465 formed by the antenna apparatus 460 of the mobile communication terminal shown in FIG. 7. Further, FIG. 9 illustrates a partial sectional view of the keypad assembly 405 and the antenna apparatus 460 of the mobile communication terminal shown in FIG. 7. As shown in these figures, on a main board 457 accommodated within the mobile terminal 400 is a cover 455. The keypad assembly 405 and the antenna apparatus 460 are configured in such a way that a silicon keypad 451, a first antenna sheet 460*a*, a flexible printed circuit board 453 for the keypad and a second antenna sheet 460*b* are sequentially stacked on the cover 455.

The silicon keypad 451 is positioned as the topmost surface of a main body of the mobile terminal 400 over the antenna apparatus 460, with its key tops protruded. The flexible printed circuit board 453 is provided with a plurality of contacts 453*a* so as to generate an electrical signal S supplied to the main board 457 depending upon the operation of respective key buttons 451*a* arranged on the keypad 451. The electrical signal S produced from the contacts 453*a* of the flexible printed circuit board 453 is supplied to the main board 457 through a data cable 453*b*. The first antenna sheet 460*a* is inserted between the silicon keypad 451 and the flexible printed circuit board 453, while the second antenna sheet 460*b* is inserted between the cover 455 and the flexible printed circuit board 453. Here, there will be no need to put together both of the first antenna sheet 460*a* and the second antenna sheet 460*b*, but instead of both, only one of the two antenna sheets may be selectively employed depending upon the characteristic of the mobile terminal in use.

The first and second antenna sheets 460*a* and 460*b* are, in themselves, capable of performing the function of an antenna, and on these first and second antenna sheets 460*a* and 460*b* may be formed the antenna pattern 465 having a topology such as shown in FIG. 8. Using the antenna pattern 465, a planar inverted F-type antenna, a meander antenna formed of curvatures and the like may be constructed. Further, it should be appreciated that, besides the above antenna pattern, other types of antenna may be implemented using a suitable wire or the like.

The first and second antenna sheets 460*a* and 460*b* are provided with ground lines 463*a* and 463*b* connected to a ground of the mobile terminal 400 and the antenna pattern 465, and power supply lines 461*a* and 461*b* for supplying electrical power F. The mobile terminal 400 carries out data transmitting/receiving operations with a base station through the antenna apparatus 460 which may be provided with both of the first antenna sheet 460*a* and the second antenna sheet 460*b*, or either one of the two antenna sheets according to the characteristic of the mobile terminal in use. In addition, using the antenna apparatus 460 equipped within the mobile terminal 400, a diversity antenna of the mobile terminal can be configured according to the present invention.

Figure 10:
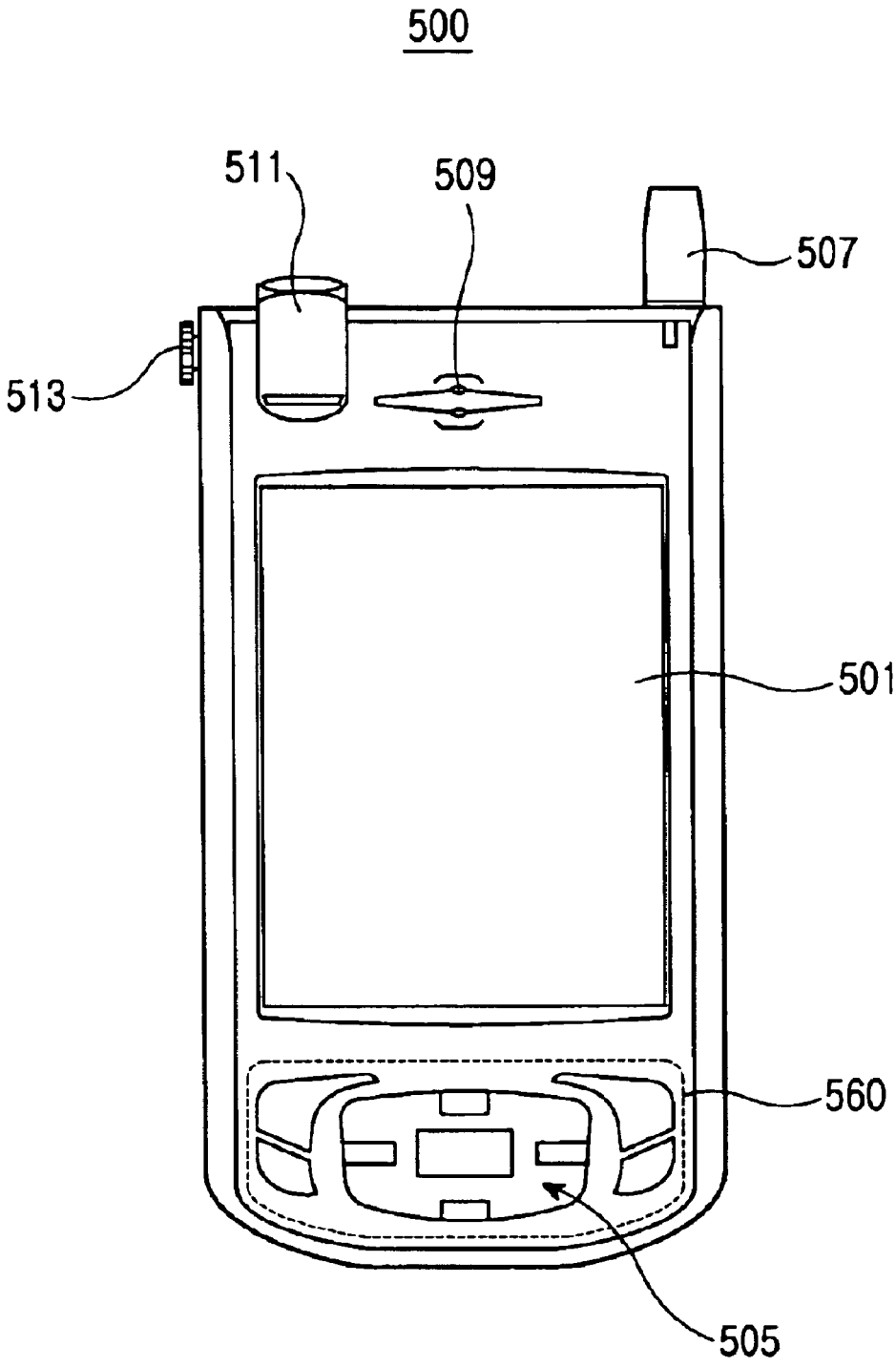
FIG. 10 illustrates a front view of a mobile communication terminal having an antenna apparatus according to another preferred embodiment of the present invention.
Figure 11:
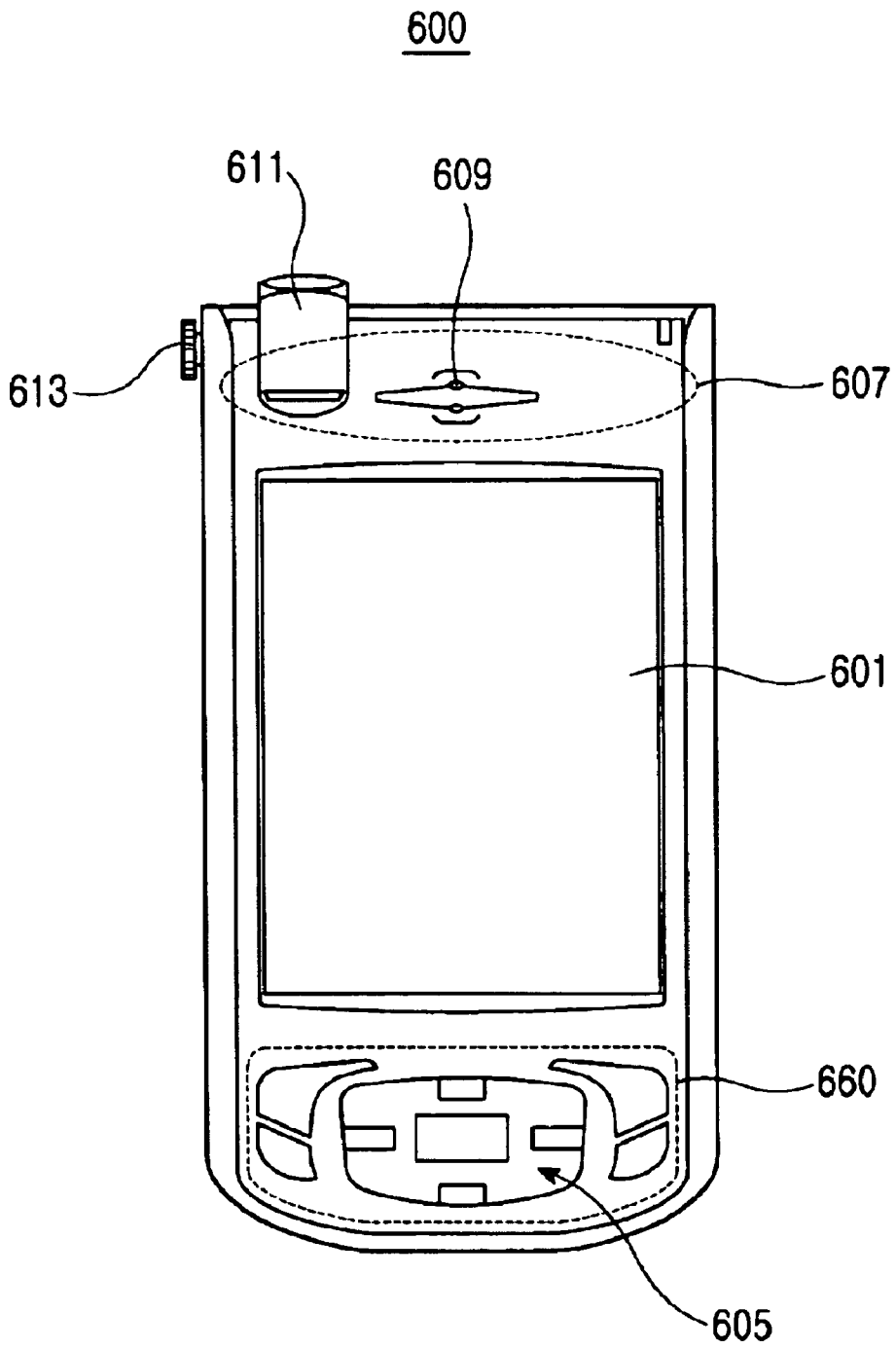
FIG. 11 illustrates a front view of a mobile communication terminal having an antenna apparatus according to still another preferred embodiment of the present invention.

Referring now to FIGS. 10 and 11, a front view of a mobile communication terminal having the antenna apparatus according to other preferred embodiments of the present invention are shown. As shown in FIG. 10, the mobile terminal 500 with a diversity antenna, having on its front a display unit 501, beneath which a keypad assembly 505 is positioned and above which a speaker 509 is disposed. The mobile terminal 500 further includes a first antenna 507 disposed in upper end and a second antenna 560 disposed underlying the keypad 505 on a lower end that is opposite to the first antenna 507. Also in the upper end of the mobile terminal 500 is disposed a camera module 511, with a photographing angle adjustable by an adjusting knob 513 disposed on one side of the upper end of the mobile terminal 500. Here, the display unit 401 may be configured in such a way that it has the largest possible area within the entire top surface of a main body of the mobile terminal 500 so as to enable viewing a motion picture or using a video phone thereon with more ease.

The first antenna 507 serves as a main antenna of the mobile terminal 500, for carrying out the transmitting/receiving of radio waves, while the second antenna 560 serves as a sub antenna of the mobile terminal, for carrying out the diversity receiving function, being configured in such a way that the silicon keypad 451, the first antenna sheet 460*a*, the flexible printed circuit board 453 for keypad and a second antenna sheet 460*b* are sequentially stacked on the cover 455, as in FIGS. 7 and 9.

Here, it will be also appreciated by one of ordinary skill in the art that, contrary to the above construction, the second antenna 560 may be configured to serve as a main antenna of the mobile terminal 500, for carrying out the transmitting/receiving of radio waves, while the first antenna 507 serves as a sub antenna of the mobile terminal, for carrying out the diversity receiving function.

Referring then to FIG. 11, the mobile terminal 600 with the diversity antenna is provided in its front with a display unit 601, beneath which display unit a keypad assembly 605 is positioned and above which a speaker 609 is disposed. The mobile terminal 600 further includes a first antenna 607 disposed in its upper end underlying the speaker 609, and a second antenna 660 underlying the keypad 605 and disposed in the lower end, opposite to the first antenna 607. On the upper end of the mobile terminal 600 is further disposed a camera module 611, with a photographing angle adjustable by an adjusting knob 613 disposed on one side of the mobile terminal 600.

The first antenna 607 accommodated within the upper end of the mobile terminal 600 may be configured with the first or second antenna sheet 460*a* or 460*b*, having topology as shown in FIG. 8, using either one of a planar inverted F-type antenna, a meander antenna with plural curvatures, a loop antenna, a chip-type antenna, etc., which best meets the requirements for a particular preferred embodiment. The first antenna 607 serves as a main antenna of the mobile terminal 600, for carrying out the transmitting/receiving of radio waves, while the second antenna 660 serves as a sub antenna of the mobile terminal, for carrying out the diversity receiving function, the second antenna being configured in such a way that the silicon keypad 451, the first antenna sheet 460*a*, the flexible printed circuit board 453 for keypad and the second antenna sheet 460*b* are sequentially stacked on the cover 455, as seen in FIGS. 7 and 8. Further, apart from the antenna apparatus having the antenna pattern formed on the first or second antenna sheet 460*a* and 460*b*, this antenna apparatus may be implemented using a preferred one of various kinds of antennas such as a planar inverted F-type antenna, a curved antenna with plural curvatures, a loop antenna, or a chip type antenna, etc. depending upon the requirements or characteristic of the mobile terminals in use. The second antenna serves as a sub antenna of the mobile terminal for achieving the diversity receiving function.

In the meantime, it will be appreciated by one of ordinary skill in the art that contrary to the above configuration of the first and second antennas, the second antenna 660 may be configured to serve as a main antenna of the mobile terminal 600, for carrying out the transmitting/receiving of radio waves, while the first antenna 607 serves as a sub antenna of the mobile terminal, for carrying out the diversity receiving function.

As apparent from the foregoing description, it will be understood that the mobile communication terminal according to the present invention is configured in such a way that the antenna apparatus is accommodated underlying the keypad assembly or together with the same within the mobile communication terminal such as, e.g., mobile phone or PDA, thereby achieving more easy built-in design and preventing damage to the antenna due to any external impact. Moreover, where the aforementioned pattern antenna is combined with an external type of antenna, it will be considerably easier for its designers to meet the design rule to ensure enough isolating distance in between the aforementioned antenna and the external antenna. Furthermore, introduction of such a diversity receiving function to either one of the two antennas according to the present invention will cause to achieve significant improvement of the quality of signal and speed of data transfer in the mobile communication terminals.

While the preferred embodiments of the present invention have been illustrated and described, it will be understood by those skilled in the art that various changes and modifications may be made, and equivalents may be substituted for elements thereof without departing from the true scope of the present invention. Therefore, it is intended that the present invention not be limited to the particular embodiments disclosed, instead, it is intended that the present invention include all embodiments falling within the scope of the appended claims.

What is claimed is:

1. An antenna apparatus for a mobile communication terminal, comprising:

a main body serving as a housing for the mobile communication terminal, said main body having therein a main board;

a keypad assembly provided with a plurality of key tops formed on a front surface of the main body; and an antenna section disposed between the main board and the keypad assembly, in a lower end of the main body, wherein the keypad assembly further comprises:

a flexible printed circuit board provided with a plurality of contacts for generating an electrical signal for inputting to the main board according to each operation of a plurality of key buttons; and at least one antenna sheet positioned between the flexible printed circuit board and the main board.

2. The antenna apparatus according to claim 1, wherein said antenna section is comprised of an antenna sheet disposed underneath the keypad assembly.

3. The antenna apparatus according to claim 1, wherein said antenna section is comprised of an antenna sheet on which a predetermined antenna pattern is formed.

4. The antenna apparatus according to claim 1, wherein the at least one antenna sheet is provided with a predetermined antenna pattern thereon.

5. The antenna apparatus according to claim 1, further comprising:

an external antenna having an antenna housing provided with a helical antenna therein and arranged in an upper end of the mobile communication terminal and a rod antenna retractable into and extendable from the mobile communication terminal through the antenna housing;

wherein said antenna section is disposed between the main board and the keypad assembly and is configured to provide a diversity receiving function in association with said external antenna.

6. The antenna apparatus according to claim 1, wherein said antenna section is selected from a group comprised of a planar inverted F-type antenna, a meander antenna with plural curvatures, a loop antenna, and a wire antenna.

7. An antenna apparatus for a mobile communication terminal, comprising:

a main body serving as a housing for the mobile communication terminal, said main body having therein a main board;

a keypad assembly provided with a plurality of key tops formed on a front surface of the main body; and an antenna section disposed between the main board and the keypad assembly, in a lower end of the main body, wherein the keypad assembly further comprises:

a flexible printed circuit board provided with a plurality of contacts for generating an electrical signal for inputting to the main board according to each operation of a plurality of key buttons; and at least one antenna sheet positioned between the flexible printed circuit board and the keypad assembly.

8. The antenna apparatus according to claim 7, wherein the at least one antenna sheet is provided with a predetermined antenna pattern thereon.

9. An antenna apparatus for a mobile communication terminal, comprising:

a main body serving as a housing for the mobile communication terminal, said main body having therein a main board;

a keypad assembly provided with a plurality of key tops exposed on a front surface of the main body;

a first antenna disposed in an upper end of the mobile communication terminal, for use in a signal receiving/transmitting function of a radio frequency signal through the mobile communication terminal;

a second antenna disposed between the main board and the keypad assembly, disposed in a lower end of the main body;

a flexible printed circuit board for the keypad assembly, arranged between the main board and the keypad assembly, including a plurality of contacts for generating an electrical signal for inputting to the main board according to each operation of a plurality of key buttons arranged in the keypad assembly; and at least one antenna sheet positioned between the flexible printed circuit board and the main board.

10. The antenna apparatus according to claim 12, wherein said second antenna is comprised of an antenna sheet underlying the keypad assembly, positioned between the main board and the keypad assembly, with a predetermined antenna pattern of a conductive material formed thereon.

11. The antenna apparatus according to claim 9, further comprising:

a flexible printed circuit board for the keypad assembly, arranged between the main board and the keypad assembly, including a plurality of contacts for generating an electrical signal for inputting to the main board according to each operation of a plurality of key buttons arranged in the keypad assembly; and at least one antenna sheet positioned between the flexible printed circuit board and the keypad assembly.

12. The antenna apparatus according to claim 9, wherein said second antenna is one selected from a group comprised of a planar inverted F-type antenna, a meander antenna with plural curvatures, a loop antenna, and a wire antenna.

13. The antenna apparatus according to claim 9, wherein said first antenna is an external type of antenna comprising an antenna housing arranged on an upper end of the mobile communication terminal, said antenna housing installed with a helical antenna therein, and a rod antenna retractable into and extendable from the mobile communication terminal.

14. The antenna apparatus according to claim 9, wherein said first antenna is installed in an upper end of the mobile communication terminal and is selected from a group comprised of a planar inverted F-type antenna, a meander antenna with plural curvatures, a loop antenna, or a wire antenna.

15. The antenna apparatus according to claim 9, wherein the first antenna is configured to serve a diversity receiving function in association with the second antenna, whereas the second antenna is configured to serve the transmitting/receiving function.

16. The antenna apparatus according to claim 9, wherein the second antenna is configured to serve a diversity receiving function in association with the first antenna, whereas the first antenna is configured to serve the transmitting/receiving function.

17. An antenna apparatus for a mobile communication terminal, comprising:

a main body having therein a main board;

a keypad assembly provided with a plurality of key tops formed on a front surface of the main body;

a flexible printed circuit board, arranged between the main board and the keypad assembly, for generating an electrical signal for inputting to the main board according to each operation of a plurality of key buttons arranged in the keypad assembly;

at least one antenna means positioned either between the flexible printed circuit board and the main board, or between the flexible printed circuit board and the keypad assembly.

18. The antenna apparatus according to claim 17, wherein said antenna means comprises at least one antenna sheet having a predetermined antenna pattern consisting of a conductive material coated thereon.

19. The antenna apparatus according to claim 17, wherein said antenna means is selected from a group comprised of a planar inverted F-type antenna, a meander antenna with plural curvatures, a loop antenna, and a wired antenna.

* * * * *